US005445057A

United States Patent [19]

Fujita

[11] Patent Number: 5,445,057

[45] Date of Patent: Aug. 29, 1995

[54] PUNCHING DIE WITH A DAMPING MEMBER

[75] Inventor: Oriya Fujita, Kanagawa, Japan

[73] Assignee: Amada Metrics Company, Limited, Kanagawa, Japan

[21] Appl. No.: 189,604

[22] Filed: Feb. 1, 1994

[30] Foreign Application Priority Data

Feb. 3, 1993 [JP] Japan ..... 5-016188

[51] Int. Cl.[6] ..... B26F 1/14; B21D 45/08

[52] U.S. Cl. ..... 83/140; 83/588; 83/635; 83/686

[58] Field of Search ..... 83/138, 139, 140, 684, 83/685, 686, 588, 635, 142, 143

[56] References Cited

U.S. PATENT DOCUMENTS

| | | | |
|---|---|---|---|
| 2,867,276 | 1/1959 | Taylor | 83/140 X |
| 2,983,176 | 5/1961 | Taylor . | |
| 3,211,035 | 10/1965 | Whistler, Sr. et al. . | |
| 3,461,762 | 8/1969 | Deni et al. | 83/635 X |
| 3,622,067 | 11/1971 | Bucy et al. . | |
| 3,683,735 | 8/1972 | Achler et al. | 83/685 X |
| 3,741,056 | 6/1973 | Saladin | 83/140 |
| 3,765,285 | 10/1973 | Achler et al. | 83/685 X |
| 3,815,459 | 6/1974 | Daniels | 83/140 |
| 4,280,383 | 7/1981 | Bryan et al. | 83/140 |
| 4,341,137 | 7/1982 | Leitch et al. | 83/588 X |
| 4,457,196 | 7/1984 | Cady | 83/140 |
| 4,843,931 | 7/1989 | Whister | 83/685 X |
| 4,856,393 | 8/1989 | Braddon | 83/685 X |
| 4,862,782 | 9/1989 | Ernst | 83/140 X |
| 4,977,804 | 12/1990 | Naito . | |
| 5,042,352 | 8/1991 | Lux | 83/140 X |
| 5,176,057 | 1/1993 | Chun et al. . | |

FOREIGN PATENT DOCUMENTS

| | | |
|---|---|---|
| 0000762 | 2/1979 | European Pat. Off. . |
| 2132515 | 11/1972 | France . |
| 2921098 | 7/1980 | Germany . |
| 3-4318 | 1/1991 | Japan . |

*Primary Examiner*—Richard K. Seidel
*Assistant Examiner*—Clark F. Dexter
*Attorney, Agent, or Firm*—Sandler, Greenblum & Bernstein

[57] ABSTRACT

A punching die includes a punch body and a punch head provided for an upper portion of the punch body. The punch head is struck by a striker. The punching die further includes a punch guide disposed at a lower portion of the punch body, a retainer collar disposed over the punch guide and fitted to the punch body, a stripping spring interposed between the punch head and the retainer collar, and an elastically deformable damping member being interposed between an upper surface of the punch guide and a lower surface of the retainer collar.

5 Claims, 2 Drawing Sheets

PUNCHING DIE WITH A DAMPING MEMBER

BACKGROUND OF THE INVENTION

1. Field of the Invention

The present invention relates to a punching die, and more specifically to a punching die which can prevent punching noise generated during punching processing of work.

2. Background Art

Generally, the punching processing is effected by moving up and down an upper die against work placed on a lower die. Therefore, whenever the work is punched out, punching noise is inevitably generated. In order to prevent the generation of the punching noise, generally a damping material such as urethane has been provided at the bottom portion of a punch guide for constituting a part of the upper die.

In the general way of providing a damping material such as urethane at the bottom portion of the punch guide, however, there exists a problem in that needle-shaped dust or refuse is inevitably produced during punching processing and further adheres onto the damping material or scratches the surface of the work to be punched out. In addition, there exist other problems in that the damping material is short in life time and difficult to be mounted at the bottom of the punching die.

SUMMARY OF THE INVENTION

With these problems in mind, therefore, it is the primary object of the present invention to provide a punching die provided with a damping member excellent in punching noise prevention performance, long in life time, and easy to be mounted on the punching die.

To achieve the above-mentioned object, the present invention provides a punching die which includes a punch body and a punch head provided for an upper portion of the punch body. The punch head is struck by a striker. The punching die further includes a punch guide disposed at a lower portion of the punch body, a retainer collar disposed over the punch guide and fitted to the punch body, a stripping spring interposed between the punch head and the retainer collar, and an elastically deformable damping member being interposed between an upper surface of the punch guide and a lower surface of the retainer collar.

Further, it is preferable that the damping member is interposed in a first part of a space between the upper surface of the punch guide and the lower surface of the retainer collar, and is not interposed in other second part of the space.

In the punching die according to the present-invention, when the striker strikes the punch head, the punch guide first collides against the work. The shock generated when the punch guide collides against the work can be absorbed by the elastically deformable damping member interposed between the lower surface of the retainer collar and the upper surface of the punch guide, so that punching noise can be reduced. Further, the damping member is long in the life time and easy to be attached on the punching die.

DETAILED DESCRIPTION OF THE PREFERRED EMBODIMENTS

An embodiment of the present invention will be described hereinbelow with reference to the attached drawings.

Figure 1:
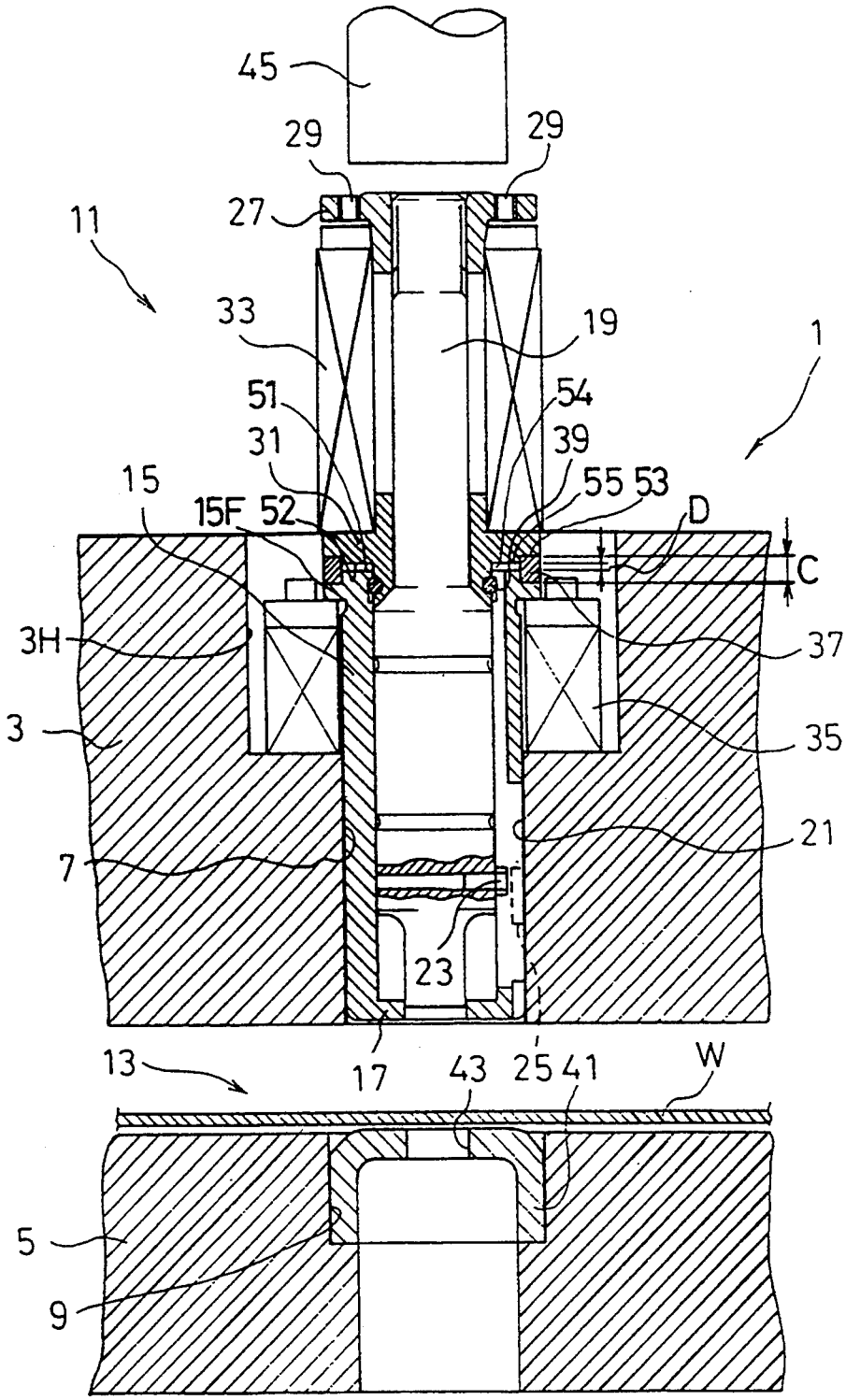
FIG. 1 is a cross-sectional view showing an embodiment of a turret punch press provided with a punching die according to the present invention.

In FIG. 1, a turret punch press 1, for instance is provided with a rotatable upper turret 3 and a rotatable.-lower turret 5 as upper and lower die holders, respectively. In the respective upper and lower turrets 3 and 5, a plurality of turret holes 7 and 9 are formed at appropriate angular intervals along the circumferences of the turrets 3 and 5, respectively. A plurality of upper and lower dies 11 and 13 are fitted into the respective upper and lower turret holes 7 and 9, respectively.

FIG. 1 shows the state in which only one upper die 11 and only one lower die 13 are mounted on the upper turret 3 and the lower turret 5, respectively. In more detail with reference to FIG. 1, a punch guide 15 movable up and down and constituting a part of the upper die 11 is fitted to the turret hole 7. A stripper plate 17 is formed integral with the lower portion of the punch guide 15.

Further, a punch body 19 is fitted to the punch guide 15 so as to be movable up and down. Further, the punch guide 15 is formed with a key groove 21 so as to be engageable with a key 23 of the punch body 19 and another key 25 of the upper turret 3, respectively.

A punch head 27 is fixed to the upper portion of the punch body 19 with screws 29. A retainer collar 31 is fitted to the punch body 19. On the upper portion of the punch guide 15, a stripping spring 33 is interposed between the retainer collar 31 and the punch head 27 so as to always urge the punch body 19 in the upward direction. In addition, a lift spring 35 is interposed between a flange portion 15F of the punch guide 15 and the bottom of a hole 3H formed in the upper turret 3 so as to always urge the punch guide 15 also in the upward direction.

An elastically deformable damping member 37 such as urethane is interposed between the upper surface 51 of the flange 15F of the punch guide 15 and the lower surface 52 of the retainer collar 31. The damping member 37 is interposed in an outer circumferential part 53.of a space 54 between the upper surface 51 and the lower surface 52, and is not interposed in a inner circumferential part 55 of the space 54. The distance C between the upper surface 51 and the lower surface 52 in the outer circumferential part 53 is longer than the distance D between the upper surface 51 and the lower surface 52 in the inner circumferential part 55. In the inner circumferential part 55, the upper surface 51 is spaced from the lower surface 52 when the punch head 27 is not struck by the striker 45, so as to provide the stroke in which the damping member is deformed.

Further, an O-ring 39 is interposed between the inner circumference of the flange 15F and the outer circumference of the retainer collar 31. On the upper side of the punch head 27, a striker 45 movable up and down is attached on an upper frame (not shown) for constituting a part of the turret punch press 1.

On the other hand, a die 41 constituting the lower die 13 is fitted to the turret hole 9 of the lower turret 5. The lower die 41 is formed with a die hole 43 at a position directly under the punch body 19.

On the basis of the above-mentioned construction, when the striker 45 is lowered to press the punch head 27 in the downward direction, the punch guide 15 is lowered by the downward motion of the punch body 19 against the elastic force of the lift spring 35, and collides against the work W placed on the lower die 41. Here, the reason why the lift spring 35 is compressed is that the spring constant of the lift spring 35 is determined to be smaller than that of the stripping spring 83. Once the punch guide 15 collides with the work W, the punch guide 15 cannot further move downward. Accordingly, the stripping spring 38 is then compressed. That is, the punch body 19 is lowered against the elastic force of the stripping spring 33, so that the work W is punched out by a punching edge formed at a lower end of the punch body 19 in cooperation with the die hole 43 of the lower die 41.

The shock generated when the punch guide 15 collides against the work W can be absorbed by an elastic deformation of the damping member 37 interposed between the upper surface of the flange 15F of the punch guide 15 and the lower surface of the retainer collar 31. In addition, an excessive deformation of the damping member 37 can be prevented by the presence of the dimension that the distance C in the outer circumferential part 53 is longer than the distance D in the inner circumferential part 55. In other words, since the urging force of the stripping spring 33 can be transmitted from the lower surface of the retainer collar 31 to the upper surface of the punch guide 15 through the damping member 37 within a predetermined deformation limit, it is possible to improve the life time of the damping member 37.

Figure 2:
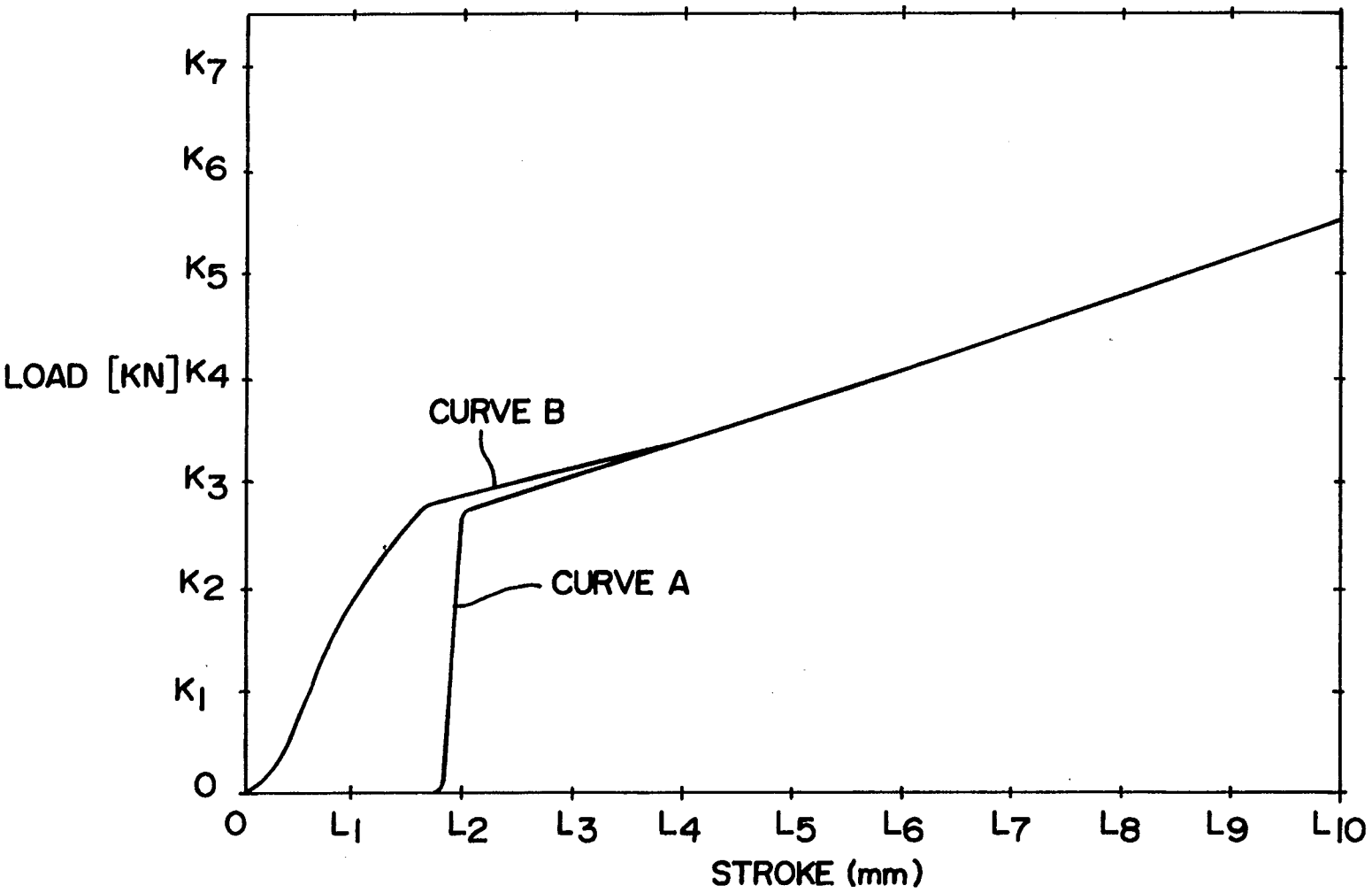
FIG. 2 is a graphical representation for assistance in explaining the shock load of the punching die according to the present invention.

When the punch guide 15 collides with the work W, since two metallic members collide with each other under a very strong urging force of the stripping spring 33, the load applied by the stripping spring 33, the damping member 37, and the lift spring 35 increases abruptly as shown by a curve A in FIG. 2, so that a shock is generated. In the punching die of the present invention, since the damping member 37 is interposed between the upper surface 15F of the punch guide 15 and the lower surface of the retainer collar 31, it is possible to reduce the load applied by the stripping spring 33 as shown by a curve B in FIG. 2, so that a shock can be reduced effectively. Therefore, it is possible to prevent the generation of punching noise, as compared with the conventional punching die. Further, since the damping member 37 is interposed between the punch guide 15 and the retainer collar 31, the damping member 37 can be mounted easily.

The above-mentioned embodiment has been described only by way of example. Without being limited thereto, however, various modifications may be made. For instance, in the embodiment shown in FIG. 1, the damping member 37 does not exist between the upper surface 51 and the lower surface 52 in the inner circumferential part 55. But even if the damping member 37 is disposed extending into the space between the upper surface 51 and the lower surface 52 in the inner circumferential part 55, it is possible to obtain the same damping effect as with the case of the above-mentioned embodiment.

As described above, in the punching die according to the present invention, since the elastically deformable damping member is interposed between the upper surface of the punch guide and the lower surface of the retainer collar, it is possible to prevent the generation of the punching noise effectively, while improving the life time of the damping member and facilitating the mounting process of the damping member on the punching die.

What is claimed is:

1. A punching die mounted on a support and driven by a striker, said punching die comprising:

a punch body;

a punch head provided on an upper portion of said punch body, said punch head for being struck by said striker;

a punch guide slidably mounted in said support and disposed in slidable contact with a lower portion of said punch body;

a retainer collar disposed over said punch guide between said punch head and said punch guide and fitted to said punch body;

a stripping spring interposed between said punch head and said retainer collar;

a lifting spring interposed between said punch guide and said support; and an elastically deformable damping member interposed between an upper surface of said punch guide and a lower surface of said retainer collar.

2. The punching die according to claim 1, wherein said damping member is interposed in a first part of a space between said upper surface of said punch guide and said lower surface of said retainer collar, and said damping member not being interposed in a second part of said space.

3. A punching die mounted on a support and driven by a striker, said punching die comprising:

a punch body;

a punch head provided on an upper portion of said punch body, said punch head for being struck by said striker;

a punch guide slidably mounted in said support and disposed around a lower portion of said punch body;

a retainer collar disposed over said punch guide between said punch head and said punch guide and fitted to said punch body;

a stripping spring interposed between said punch head and said retainer collar;

a lifting spring interposed between said punch guide and said support; and an elastically deformable damping member interposed between an upper surface of said punch guide and a lower surface of said retainer collar;

wherein said damping member is interposed in a first part of a space between said upper surface of said punch guide and said lower surface of said retainer collar, and said damping member not being interposed in a second part of said space; and wherein a distance between said upper surface and said lower surface in said first part is longer than a distance between said upper surface and said lower surface in said second part, and in said second part, said upper surface is spaced from said lower surface when said punch head is not struck by said striker.

4. The punching die according to claim 3, wherein said space is ring-shaped.

5. The punching die according to claim 1, wherein said first part is an outer circumference of said space, and said second part is in inner circumference of said space.

* * * * *

UNITED STATES PATENT AND TRADEMARK OFFICE

CERTIFICATE OF CORRECTION

PATENT NO. : 5,445,057
DATED : August 29, 1995
INVENTOR(S) : Oriya FUJITA

It is certified that error appears in the above-indentified patent and that said Letters Patent is hereby corrected as shown below:

On the cover, in section [73], "Assignee", line 1, change "Metrics"to ---Metrecs---.

At column 1, lines 54 and 55, change "present-invention" to ---present invention---.

At column 2, line 48, change "53.of" to ---53 of---.

At column 3, line 9, change "83." to ---33.---.

At column 3, line 12, change "38" to ---33---.

At column 4, line 64 (claim 5, line 1), change "1," to ---4,---.

Signed and Sealed this

Seventh Day of May, 1996

Bruce Lehman

*Attest:*

BRUCE LEHMAN

*Attesting Officer*

*Commissioner of Patents and Trademarks*